US007374846B2

(12) United States Patent
Lee et al.

(10) Patent No.: US 7,374,846 B2
(45) **Date of Patent: *May 20, 2008**

(54) METHOD FOR PREPARING OF NON-MAGNETIC MONOCOMPONENT COLOR TONER HAVING SUPERIOR LONG TERM STABILITY

(75) Inventors: Hyeung-Jin Lee, Daejeon (KR); Tae-Hee Yoon, Daejeon (KR); Joo-Yong Park, Daejeon (KR); Chang-Soon Lee, Daejeon (KR)

(73) Assignee: LG Chem, Ltd. (KR)

( * ) Notice: Subject to any disclaimer, the term of this patent is extended or adjusted under 35 U.S.C. 154(b) by 130 days.

This patent is subject to a terminal disclaimer.

(21) Appl. No.: 11/255,471

(22) Filed: Oct. 21, 2005

(65) Prior Publication Data

US 2007/0020544 A1 Jan. 25, 2007

Related U.S. Application Data

(63) Continuation-in-part of application No. 10/480,509, filed as application No. PCT/KR03/00714 on Apr. 9, 2003, now abandoned.

(30) Foreign Application Priority Data

Apr. 11, 2002 (KR) ..... 2002-0019808

(51) Int. Cl.
*G03G 9/087* (2006.01)
*G03G 9/08* (2006.01)

(52) U.S. Cl. ..... 430/108.11; 430/108.1; 430/108.22; 430/108.4; 430/108.7; 430/137.11; 430/137.21

(58) Field of Classification Search ..... 430/108.11, 430/108.7, 108.4, 108.22, 108.1, 137.11, 430/137.21
See application file for complete search history.

(56) References Cited

U.S. PATENT DOCUMENTS 5,350,657 A 9/1994 Anno et al.
5,620,824 A * 4/1997 Okado et al. ..... 430/108.6
5,683,845 A 11/1997 Sata et al.
6,174,641 B1 1/2001 Nakamura et al.
6,187,489 B1 2/2001 Oishi et al.

FOREIGN PATENT DOCUMENTS

| | | |
|---|---|---|
| JP | 04186251 | 7/1992 |
| JP | 05061244 | 3/1993 |
| JP | 06118699 | 4/1994 |
| JP | 7-64330 | 3/1995 |
| JP | 07168388 | 7/1995 |
| JP | 11-38670 | 2/1999 |
| JP | 2000-29242 | 1/2000 |
| JP | 2000-267346 | 9/2000 |
| JP | 2000-275900 | 10/2000 |
| WO | WO-03/087951 A1 * | 10/2003 |

OTHER PUBLICATIONS

Diamond, A.S., ed., *Handbook of Imaging Materials*, Marcel Dekker, Inc., NY (1991), pp. 169-170.*
PCT International Search Report; International application No. PCT/KR03/00714; Interanational filing date: Apr. 9, 2003; Date of Mailing: Jun. 19, 2003.
International Search Report for International Application No. PCT/DE2003/000714; International Filing Date Feb. 28, 2003; Date of Completion Apr. 1, 2004.

* cited by examiner

*Primary Examiner*—Janis L. Dote
(74) *Attorney, Agent, or Firm*—Cantor Colburn LLP

(57) ABSTRACT

The present invention relates to a non-magnetic monocomponent color toner composition and a method for preparing the same, and more particularly to a non-magnetic monocomponent color toner composition having a narrow charge distribution, good charging characteristics, good environmental independence, superior image characteristics, high transfer efficiency and long-term stability caused by significantly improved charge maintenance capability, and a method for preparing the same. The non-magnetic monocomponent color toner composition of the present invention is prepared by coating organic particles having an average particle size of 0.3 to 2.0 μm, organic particles having an average particle size of 0.05 to 0.25 μm, and silica on toner mother particles.

11 Claims, No Drawings

METHOD FOR PREPARING OF NON-MAGNETIC MONOCOMPONENT COLOR TONER HAVING SUPERIOR LONG TERM STABILITY

CROSS REFERENCE TO RELATED APPLICATIONS

This application is a Continuation-in-Part Application of U.S. patent application Ser. No. 10/480,509 filed Dec. 11, 2003, now abandonded, which is a national stage filing of international application PCT/KR03/00714 filed on Apr. 9, 2003 which claims priority to Korean patent application No. 2002-0019808 filed on Apr. 11, 2002, each of which is incorporated herein in its entirety.

BACKGROUND OF THE INVENTION (a) Field of the Invention

The present invention relates to a non-magnetic monocomponent color toner composition and a method for preparing the same, and more particularly to a non-magnetic monocomponent color toner composition having a narrow charge distribution, good charging characteristics, good environmental independence, superior image characteristics, high transfer efficiency, and long-term stability caused by significantly improved charge maintenance capability, and a method for preparing the same.

(b) Description of the Related Art

The recent hard-copying and printing techniques using image formation methods, such as electrophotographs, are rapidly moving toward full color from black and white. In particular, the color printer market is expanding very rapidly. In general, formation of color images by full color electrophotography is carried out with three colors comprising cyan, magenta, and yellow, or four colors further comprising black, to present all colors. In this rapidly growing full color market, high image quality, good reliability, compactness, lightweightness, low price, high speed, low energy consumption and recyclability, and so forth are highly required. Improvement and development of image formation methods and toners to satisfy these requirements are widely progressing.

In general, image formation in electrophotography comprises:

1. a charging step of uniformly charging a drum surface;
2. an exposure step of exposing the drum surface and forming an electrostatic latent image;
3. a developing step of developing the latent image on the drum surface using a toner formed on the surface of a developing roller and obtaining a toner image;
4. a transfer step of transferring the toner image;
5. a fixing step of settling the toner image; and
6. a cleaning step of removing toner remaining on the drum surface from the transfer step.

Each step of the image formation process in electrophotography requires the following characteristics from a toner. The developing step requires an appropriate charging of the toner, charge maintenance, and environmental independence. The transfer step requires good transfer characteristics. The fixing step requires low-temperature settlement characteristics and offset resistance. And lastly, the cleaning step requires good cleaning characteristics and contamination resistance. Recently, the above characteristics have become more important with the trend toward high resolution, high speed, and full color.

With regard to long-term maintenance of image quality for repeated printing, there is a method of mixing four colors directly in a photoconductive drum in the transfer step. And recently, indirect transfer image formation has been mainly used in full color printers because it can offer high speed and good image quality. In indirect transfer image formation, a toner image on the drum surface is repeatedly transferred to an intermediate transfer belt by each color, and then the image is transferred paper as a whole.

However, indirect transfer image formation requires more toner transfer steps. Therefore, better and more exact transfer characteristics are required to obtain a good image quality. Also, research on additives, toner shape, surface structure control, and so forth are required to improve charging stability or transfer efficiency, in order to obtain stable long-term and high-quality full color images.

With regard to the cleaning step, reduction of remaining toners after transfer and reducing the cleaner size are important tasks for improving environmental independence. In particular, for a three-color comprising cyan, magenta, and yellow, or a four-color toner further comprising black, toners remaining after transfer are a significant problem.

To overcome these problems of the transfer step and the cleaning step, it is important to reduce remaining toners. For this purpose, it is important to improve transfer efficiency of the toner, and to maintain it. To improve transfer efficiency of the toner, it is necessary to reduce the toner's adhesivity to the photoconductive drum.

Fine particles, such as silica, may be added to the toner to reduce its adhesivity to the photoconductive drum. The fine particles reduce the toner's adhesivity to the drum and improve its transfer efficiency. To obtain good transfer efficiency, many fine particles should be coated on the toner surface. Consequently, the addition amount of the fine particles increases and the toner charging characteristics become poor. Moreover, the fine particles may adhere to electrostatic latent image carriers, and filming or fixing problems may occur. Especially, silica particles may cause problems of image density irregularity at low temperature and humidity, and non-image area contamination at high temperature and humidity, because they are highly environment-dependent.

As a method for improving environmental independence of a toner, addition of inorganic fine particles having electric resistance lower than that of silica particles and good-charge exchange ability, such as titanium oxide particles, is known. However, if inorganic fine particles having lower electric resistance are used, charge distribution of the toner may change easily. Also, poor second transfer when using an intermediate transfer belt or retransfer of wrong sign color toner during multiple transfers may be caused.

A method of increasing resistance of inorganic fine particles by treating the surface with a silane coupling agent, etc. was proposed to solve this problem. However, cohesion of the fine particles becomes so severe that their dispersibility on the toner surface decreases. Also, fluidity of the toner may decrease or blocking may occur due to free cohesioned particles.

Accordingly, research on a color toner having a narrow charge distribution, good charging characteristics and environmental independence, and superior image characteristics, transfer efficiency, and long-term stability, is highly needed.

SUMMARY OF THE INVENTION

An object of the present invention is to provide a non-magnetic monocomponent color toner composition having superior image characteristics, transfer efficiency, and long-term stability.

Another object of the present invention is to provide a method for preparing a non-magnetic monocomponent color toner composition having a narrow charge distribution, good charging characteristics and environmental independence, superior image characteristics, high transfer efficiency, and long-term stability caused by significantly improved charge maintenance capability.

To attain the objects, the present invention provides a non-magnetic monocomponent color toner composition comprising:

a) 100 weight parts of toner mother particles;

b) 0.1 to 1.5 weight parts of organic particles having an average particle size of 0.3 to 2.0 μm, which are coated on the toner mother particles;

c) 0.1 to 1.5 weight parts of organic particles having an average particle size of 0.05 to 0.25 μm, which are coated on the toner mother particles; and d) 1.0 to 3.0 weight parts of silica, which is coated on the toner mother particles.

The present invention also provides a method for preparing a non-magnetic monocomponent color toner, which comprises a step of coating organic particles having an average particle size of 0.3 to 2.0 μm, organic particles having an average particle size of 0.05 to 0.25 μm, and silica on surface the of toner mother particles.

DETAILED DESCRIPTION OF THE PREFERRED EMBODIMENTS

Hereinafter, the present invention will be explained in more detail.

The present inventors worked on a method for preparing a color toner for electrostatic image development, which offers a narrow charge distribution, good charging characteristics and environmental independence, and long-term stability. In doing so, they realized that toner mother particles coated with organic particles having an average particle size of 0.3 to 2.0 μm, organic particles having an average particle size of 0.05 to 0.25 μm, and silica have a narrow charge distribution, good charging characteristics and environmental independence, superior image characteristics, transfer efficiency and long-term stability caused by significantly improved charge maintenance capability.

In the present invention, charging characteristics of a toner are affected by the organic particles on the surface of the toner particles, and by the silica surrounding the organic particles. Frictional resistance on the toner between a sleeve and a charging blade during charging is decreased to prevent solid adhesion on the charging blade. Therefore, an image that is stable for a long time can be obtained. Also, the present invention can maximize the frictional resistance decrease effect by using organic particles having different average particle sizes.

The present invention relates to a non-magnetic monocomponent color toner composition prepared by coating 0.1 to 1.5 weight parts of organic particles having an average particle size of 0.3 to 2.0 μm, specifically 0.9 to 2.0 μm, more specifically 1.0 to 2.0 μm, yet more specifically 1.2 to 2.0 μm, still yet more specifically 1.5 to 2.0 μm, and even more specifically 1.7 to 2.0 μm; 0.1 to 1.5 weight parts of organic particles having an average particle size of 0.05 to 0.25 μm, specifically of 0.07 to 0.25 μm, more specifically 0.1 to 0.25 μm, more specifically 0.12 to 0.25 μm, yet more specifically 0.15 to 0.25 μm, still yet more specifically 0.17 to 0.25 μm, and even more specifically 0.2 to 0.25 μm; and 1.0 to 3.0 weight parts of silica on 100 weight parts of toner mother particles. All ranges are inclusive and combinable.

The organic particles having an average particle size of the 0.3 to 2.0 μm range are comprised in 0.1 to 1.5 weight parts for 100 weight parts of toner mother particles. If their content is below 0.1 weight parts, the frictional resistance decrease effect is slight. Otherwise, if it exceeds 1.5 weight parts, excessive organic particles on the toner particles cause contamination problems, such as PCR contamination and drum filming.

The organic particles having an average particle size of the 0.05 to 0.25 μm range are comprised in 0.1 to 1.5 weight parts for 100 weight parts of toner mother particles. If their content is below 0.1 weight parts, the frictional resistance decrease effect is slight. Otherwise, if it exceeds 1.5 weight parts, the transfer efficiency may decrease.

The organic particles having an average particle size of the 0.3 to 2.0 μm range and the organic particles having an average particle size of the 0.05 to 0.25 μm range have polymer structures and can be prepared from the following monomers.

For the monomers: styrenes, such as styrene, methylstyrene, dimethylstyrene, ethylstyrene, phenylstyrene, chlorostyrene, hexylstyrene, octylstyrene, and nonylstyrene; vinyl halides, such as vinyl chloride and vinyl fluoride; vinyl esters, such as vinyl acetate and vinyl benzoate; methacrylates, such as methylmethacrylate, ethylmethacrylate, propylmethacrylate, n-butylmethacrylate, isobutylmethacrylate, 2-ethylhexylmethacrylate, and phenyl acrylate; acrylic acid derivatives, such as acrylonitrile and methacrylonitrile; acrylates, such as methyl acrylate, ethyl acrylate, butyl acrylate, and phenyl acrylate; tetrafluoroethylene; or 1,1-difluoroethylene can be used alone or in combination. Also, styrene resin, epoxy resin, polyester resin, or polyurethane resin may be used along with the monomers.

The silica is comprised in 1.0 to 3.0 weight parts for 100 weight parts of toner mother particles. If its content is below 1.0 weight part, the frictional resistance decrease effect is slight. Otherwise, if it exceeds 3.0 weight parts, fixing is difficult. Preferably, the average particle size of the silica is 7 to 40 nm.

The present invention provides a toner having good charging characteristics, charge maintenance capability, and color characteristics, and it is environmentally friendly and capable of offering stable images for the currently prevalent indirect transfer method, by coating the organic particles having an average particle size of the 0.3 to 2.0 μm range, the organic particles having an average particle size of the 0.05 to 0.25 μm range, and the silica on the toner mother particles.

The organic particles and the silica may be electrostatically adhered to the surface of the toner mother particles. However, it is preferable that the organic particles and the silica are settled on the surface of the toner mother particles by a mechanical mixing treatment, particularly by using a HENSCHEL MIXER® or a hybridizer. When a HENSCHEL MIXER® is used, a stirring rate of over 10 m/sec of tip speed is required. For electrostatic or mechanical adhesion to a binder resin, a high shearing force is required. Additionally, it is preferable to use a HENSCHEL MIXER® with a stirring rate of over 10 m/sec (tip speed) when coating the organic particles organic particles to prevent solid adhesion.

The toner mother particles comprise a binder resin and a coloring agent.

For the binder resin: styrenes, such as styrene, chlorostyrene, and vinylstyrene; olefins, such as ethylene, propylene, butylenes, and isoprene; vinyl esters, such as vinyl acetate, vinyl propionate, vinyl benzoate, and vinyl lactate; methacrylate esters, such as methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate; vinyl ethers, such as vinyl methyl ether, vinyl ethyl ether, and vinyl butyl ether; or vinyl ketones, such as vinyl methyl ketone, vinyl hexyl ketone, and vinyl isopropenyl ketone may be used alone or in combination.

Preferably, styrene resin or polyester resin is used. For the styrene resin, polystyrene, styrene acrylate alkyl copolymer, styrene methacrylate alkyl copolymer, styrene acrylonitrile copolymer, styrene butadiene copolymer, styrene maleic anhydride copolymer, polyethylene, or polypropylene may be used. For the polyester resin, a resin prepared by polymerization condensation with bisphenol A alkylene oxide additives, such as maleate, phthalate, and cytracotate of polyoxypropylene(2,2); ethylene glycol; or polytetramethylene glycol, can be used. Polyurethane resin, epoxy resin, silicon resin, and so forth can be used together.

For the coloring agent, carbon black, a magnetic component, and a dye or pigment can be used. Specific examples include one or more of the following compounds nigrosine dye, aniline blue, charcoal blue, chrome yellow, navy blue, DUPONT® oil red, methylene blue chloride, phthalocyanine blue, lamp black, rose bengal, C.I. Pigment Red 48:1, C.I. Pigment Red 48:4, C.I. Pigment Red 122, C.I. Pigment Red 57:1, C.I. Pigment Red 257, C.I. Pigment Yellow 97, C.I. Pigment Yellow 12, C.I. Pigment Yellow 17, C.I. Pigment Yellow 14, C.I. Pigment Yellow 13, C.I. Pigment Yellow 16, C.I. Pigment Yellow 81, C.I. Pigment Yellow 126, C.I. Pigment Yellow 127, C.I. Pigment Blue 9, C.I. Pigment Blue 15, C.I. Pigment Blue 15:1, and C.I. Pigment Blue 15:3.

Also, inorganic oxide particles, such as $SiO_2$, $TiO_2$, MgO, $Al_2O_3$, MnO, ZnO, $Fe_2O_3$, CaO, $BaSO_4$, $CeO_2$, $K_2O$, $Na_2O$, $ZnO_2$, CaO.SiO, $K_2O.(TiO_2)_n$, and $Al_2O_3.2SiO_2$, hydrophobically treated with hexamethyl disilaznae, dimethyidichlorosilane, or octyltrimethoxysilane, can be added to the toner mother particles as a fluidity promoting agent. In addition, a release agent or a charge-controlling agent can be further added.

For the release agent, polyethylene wax or polypropylene wax with a low molecular weight can be used. Also, a metal salt of a fatty acid can be used. The fatty acid used in the metal salt of a fatty acid can be a natural or synthetic fatty acid having 4 to 40 carbon atoms. It may be either saturated or unsaturated, and it may have hydroxy, aldehyde, or epoxy groups. For example, capuronic acid, capurylic acid, capurynic acid, lailinic acid, miristic acid, millistrike oleic acid, palmitic acid, palmitoleic acid, stearic acid, oleic acid, linolenic acid, arachinic acid, behenic acid, elchaic acid, montenic acid, isostearic acid, epoxystearic acid, and so forth can be used.

For the charge-controlling agent, a chromium-containing azo-metal complex, a metal salicylate complex, a chromium-containing organic dye, or a quaternary ammonium salt can be used.

Preferably, a non-magnetic monocomponent color toner prepared according to the present invention has an average particle size of less than or equal to 20 μm, more preferably 3 to 15 μm.

The preparing method according to the present invention provides a toner having a narrow charge distribution, good charging characteristics, charge maintenance capability, and color characteristics, and superior image characteristics, high transfer efficiency, and long-term stability. Also, it is more environmentally friendly and can offer stable images for the currently prevalent indirect transfer method.

Hereinafter, the present invention is described in more detail through Examples and Comparative Examples. However the following Examples are only for the understanding of the present invention, and the present invention is not limited by the following Examples.

EXAMPLES

Example 1

(Preparation of Cyan Toner Mother Particles)

92 weight parts of polyester resin (molecular weight=$2.5\times10^4$), 5 weight parts of phthalocyanine P.BI. 15:3, 1 weight part of quaternary ammonium salt, and 2 weight parts of low-molecular-weight polypropylene were mixed in a HENSCHEL MIXERS®. The mixture was kneaded at 165° C. in a two-axis melt kneader. Then, it was crushed with a jet mill crusher and classified with a wind classifier to obtain toner mother particles having an average particle size of 9.0 μm.

(Preparation of Non-Magnetic Monocomponent Color Toner)

For 100 weight parts of the prepared toner mother particles, 0.1 weight parts of polyvinylidene fluoride (PVDF) having an average particle size of 0.1 μm and 0.1 weight parts of polytetrafluoroethylene (PTFE) having an average particle size of 2.0 μm were coated on the surface of the toner mother particles as organic particles. For 100 weight parts of the toner mother particles, 2 weight parts of silica having an average particle size of 12 nm were stirred for 5 minutes at a line speed of 20 m/s along with the organic particles. Then, it was mixed and coated to obtain a non-magnetic monocomponent color toner.

Examples 2 to 39

The procedure of Example 1 was carried out with the following organic particle compositions.

TABLE 1

| Classification | Organic Particles A (Average particle size = 0.3 to 2.0 μm) | Organic Particles B (Average particle size = 0.05 to 0.25 μm) |
|---|---|---|
| Example 2 | 0.1 weight parts of 2.0 μm PMMA | 0.1 weight parts of 0.1 μm PVDF |
| Example 3 | 1.5 weight parts of 2.0 μm PTFE | 0.1 weight parts of 0.1 μm PVDF |
| Example 4 | 1.5 weight parts of 2.0 μm PMMA | 0.1 weight parts of 0.1 μm PVDF |
| Example 5 | 0.1 weight parts of 2.0 μm PTFE | 1.5 weight parts of 0.1 μm PVDF |
| Example 6 | 0.1 weight parts of 2.0 μm PMMA | 1.5 weight parts of 0.1 μm PVDF |
| Example 7 | 1.5 weight parts of 2.0 μm PTFE | 1.5 weight parts of 0.1 μm PVDF |
| Example 8 | 1.5 weight parts of 2.0 μm PMMA | 1.5 weight parts of 0.1 μm PVDF |
| Example 9 | 0.5 weight parts of 2.0 μm PTFE | 0.5 weight parts of 0.1 μm PVDF |
| Example 10 | 0.5 weight parts of 2.0 μm PMMA | 0.5 weight parts of 0.1 μm PVDF |

TABLE 1-continued

| Classification | Organic Particles A (Average particle size = 0.3 to 2.0 μm) | Organic Particles B (Average particle size = 0.05 to 0.25 μm) |
|---|---|---|
| Example 11 | 0.1 weight parts of 0.4 μm PVDF | 0.1 weight parts of 0.1 μm PVDF |
| Example 12 | 0.1 weight parts of 0.4 μm PMMA | 0.1 weight parts of 0.1 μm PVDF |
| Example 13 | 0.1 weight parts of 0.4 μm PVDF | 1.5 weight parts of 0.1 μm PVDF |
| Example 14 | 0.1 weight parts of 0.4 μm PMMA | 1.5 weight parts of 0.1 μm PVDF |
| Example 15 | 1.5 weight parts of 0.4 μm PVDF | 0.1 weight parts of 0.1 μm PVDF |
| Example 16 | 1.5 weight parts of 0.4 μm PMMA | 0.1 weight parts of 0.1 μm PVDF |
| Example 17 | 1.5 weight parts of 0.4 μm PVDF | 1.5 weight parts of 0.1 μm PVDF |
| Example 18 | 1.5 weight parts of 0.4 μm PMMA | 1.5 weight parts of 0.1 μm PVDF |
| Example 19 | 0.5 weight parts of 0.4 μm PMMA | 0.5 weight parts of 0.1 μm PVDF |
| Example 20 | 0.1 weight parts of 0.4 μm PVDF | 0.1 weight parts of 0.15 μm PMMA |
| Example 21 | 0.1 weight parts of 0.4 μm PMMA | 0.1 weight parts of 0.15 μm PMMA |
| Example 22 | 1.5 weight parts of 0.4 μm PVDF | 1.5 weight parts of 0.15 μm PMMA |
| Example 23 | 1.5 weight parts of 0.4 μm PMMA | 1.5 weight parts of 0.15 μm PMMA |
| Example 24 | 0.1 weight parts of 0.4 μm PVDF | 1.5 weight parts of 0.15 μm PMMA |
| Example 25 | 0.1 weight parts of 0.4 μm PMMA | 1.5 weight parts of 0.15 μm PMMA |
| Example 26 | 1.5 weight parts of 0.4 μm PVDF | 0.1 weight parts of 0.15 μm PMMA |
| Example 27 | 1.5 weight parts of 0.4 μm PMMA | 0.1 weight parts of 0.15 μm PMMA |
| Example 28 | 0.5 weight parts of 0.4 μm PVDF | 0.5 weight parts of 0.15 μm PMMA |
| Example 29 | 0.5 weight parts of 0.4 μm PMMA | 0.5 weight parts of 0.15 μm PMMA |
| Example 30 | 0.1 weight parts of 2.0 μm PTFE | 0.1 weight parts of 0.15 μm PMMA |
| Example 31 | 0.1 weight parts of 2.0 μm PMMA | 0.1 weight parts of 0.15 μm PMMA |
| Example 32 | 1.5 weight parts of 2.0 μm PTFE | 1.5 weight parts of 0.15 μm PMMA |
| Example 33 | 1.5 weight parts of 2.0 μm PMMA | 1.5 weight parts of 0.15 μm PMMA |
| Example 34 | 0.1 weight parts of 2.0 μm PTFE | 1.5 weight parts of 0.15 μm PMMA |
| Example 35 | 0.1 weight parts of 2.0 μm PMMA | 1.5 weight parts of 0.15 μm PMMA |
| Example 36 | 1.5 weight parts of 2.0 μm PTFE | 0.1 weight parts of 0.15 μm PMMA |
| Example 37 | 1.5 weight parts of 2.0 μm PMMA | 0.1 weight parts of 0.15 μm PMMA |
| Example 38 | 0.5 weight parts of 2.0 μm PTFE | 0.5 weight parts of 0.15 μm PMMA |
| Example 39 | 0.5 weight parts of 2.0 μm PMMA | 0.5 weight parts of 0.15 μm PMMA |

Note:
PMMA = polymethyl methacrylate
PVDF = polyvnylidene fluoride
PTFE = polytetrafluoroethylene

Comparative Examples 1 to 43

The procedure of Example 1 was carried out with the following organic particle compositions.

TABLE 2

| Classification | Organic Particles A | Organic Particles B |
|---|---|---|
| Comp. Example 1 | 0.5 weight parts of 0.15 μm PMMA | 0.5 weight parts of 0.1 μm PVDF |
| Comp. Example 2 | 1.5 weight parts of 0.15 μm PMMA | 1.5 weight parts of 0.1 μm PVDF |
| Comp. Example 3 | 0.5 weight parts of 0.4 μm PMMA | 0.5 weight parts of 0.4 μm PVDF |
| Comp. Example 4 | 1.5 weight parts of 0.4 μm PMMA | 1.5 weight parts of 0.4 μm PVDF |
| Comp. Example 5 | 0.5 weight parts of 2.0 μm PMMA | 0.5 weight parts of 2.0 μm PMMA |
| Comp. Example 6 | 1.5 weight parts of 2.0 μm PMMA | 1.5 weight parts of 2.0 μm PMMA |
| Comp. Example 7 | 0.5 weight parts of 4.0 μm PTFE | 0.5 weight parts of 4.0 μm PMMA |
| Comp. Example 8 | 1.5 weight parts of 4.0 μm PTFE | 1.5 weight parts of 4.0 μm PMMA |
| Comp. Example 9 | 1.0 weight parts of 0.4 μm PVDF | 0.05 weight parts of 0.1 μm PVDF |
| Comp. Example 10 | 1.0 weight parts of 0.4 μm PVDF | 2.0 weight parts of 0.1 μm PVDF |
| Comp. Example 11 | 1.0 weight parts of 0.4 μm PMMA | 0.05 weight parts of 0.1 μm PVDF |
| Comp. Example 12 | 1.0 weight parts of 0.4 μm PMMA | 2.0 weight parts of 0.1 μm PVDF |
| Comp. Example 13 | 1.0 weight parts of 2.0 μm PTFE | 0.05 weight parts of 0.1 μm PVDF |
| Comp. Example 14 | 1.0 weight parts of 2.0 μm PMMA | 2.0 weight parts of 0.1 μm PVDF |

TABLE 2-continued

| Classification | Organic Particles A | Organic Particles B |
|---|---|---|
| Comp. Example 15 | 1.0 weight parts of 4.0 μm PMMA | 0.5 weight parts of 0.1 μm PVDF |
| Comp. Example 16 | 1.0 weight parts of 4.0 μm PTFE | 0.5 weight parts of 0.1 μm PVDF |
| Comp. Example 17 | 1.0 weight parts of 0.4 μm PVDF | 0.05 weight parts of 0.15 μm PMMA |
| Comp. Example 18 | 1.0 weight parts of 0.4 μm PVDF | 2.0 weight parts of 0.15 μm PMMA |
| Comp. Example 19 | 1.0 weight parts of 0.4 μm PMMA | 0.05 weight parts of 0.15 μm PMMA |
| Comp. Example 20 | 1.0 weight parts of 0.4 μm PMMA | 2.0 weight parts of 0.15 μm PMMA |
| Comp. Example 21 | 1.0 weight parts of 2.0 μm PTFE | 0.05 weight parts of 0.15 μm PMMA |
| Comp. Example 22 | 1.0 weight parts of 2.0 μm PMMA | 2.0 weight parts of 0.15 μm PMMA |
| Comp. Example 23 | 1.0 weight parts of 4.0 μm PMMA | 0.5 weight parts of 0.15 μm PMMA |
| Comp. Example 24 | 1.0 weight parts of 4.0 μm PTFE | 0.5 weight parts of 0.15 μm PMMA |
| Comp. Example 25 | 0.05 weight parts of 0.4 μm PVDF | 0.5 weight parts of 0.1 μm PVDF |
| Comp. Example 26 | 2.0 weight parts of 0.4 μm PVDF | 0.5 weight parts of 0.1 μm PVDF |
| Comp. Example 27 | 0.05 weight parts of 0.4 μm PMMA | 0.5 weight parts of 0.1 μm PVDF |
| Comp. Example 28 | 2.0 weight parts of 0.4 μm PMMA | 0.5 weight parts of 0.1 μm PVDF |
| Comp. Example 29 | 0.05 weight parts of 2.0 μm PTFE | 0.5 weight parts of 0.1 μm PVDF |
| Comp. Example 30 | 2.0 weight parts of 2.0 μm PTFE | 0.5 weight parts of 0.1 μm PVDF |
| Comp. Example 31 | 0.05 weight parts of 2.0 μm PMMA | 0.5 weight parts of 0.1 μm PVDF |
| Comp. Example 32 | 2.0 weight parts of 2.0 μm PMMA | 0.5 weight parts of 0.1 μm PVDF |
| Comp. Example 33 | 0.05 weight parts of 0.4 μm PVDF | 0.5 weight parts of 0.15 μm PMMA |
| Comp. Example 34 | 2.0 weight parts of 0.4 μm PVDF | 0.5 weight parts of 0.15 μm PMMA |
| Comp. Example 35 | 0.05 weight parts of 0.4 μm PMMA | 0.5 weight parts of 0.15 μm PMMA |
| Comp. Example 36 | 2.0 weight parts of 0.4 μm PMMA | 0.5 weight parts of 0.15 μm PMMA |
| Comp. Example 37 | 0.05 weight parts of 2.0 μm PTFE | 0.5 weight parts of 0.15 μm PMMA |
| Comp. Example 38 | 2.0 weight parts of 2.0 μm PTFE | 0.5 weight parts of 0.15 μm PMMA |
| Comp. Example 39 | 0.05 weight parts of 2.0 μm PMMA | 0.5 weight parts of 0.15 μm PMMA |
| Comp. Example 40 | 0.05 weight parts of 4.0 μm PMMA | 0.05 weight parts of 0.1 μm PVDF |
| Comp. Example 41 | 0.05 weight parts of 4.0 μm PTFE | 0.05 weight parts of 0.1 μm PVDF |
| Comp. Example 42 | 2.0 weight parts of 4.0 μm PMMA | 0.05 weight parts of 0.1 μm PVDF |
| Comp. Example 43 | 2.0 weight parts of 4.0 μm PTFE | 0.05 weight parts of 0.1 μm PVDF |

Test Example 1

Non-magnetic monocomponent color toners prepared in Examples 1 to 39 and Comparative Examples 1 to 43 were used to print 5000 sheets of paper with a non-magnetic monocomponent development printer (HP4500; Hewlett-Packard Company) under the condition of normal temperature and humidity (20° C., 55% RH). Image density, transfer efficiency, and long-term stability were determined as follows. The result is shown in Table 3.

a) Image density (I.D)—Density of solid area image was determined with a Macbeth densitiometer RD918.

A: image density=1.4 or higher

B: image density=1.3 or higher

C: image density=1.2 or lower

D: image density=1.0 or lower b) Transfer efficiency: For the printed 5000 sheets of paper, number of wasted sheets was subtracted from total number of sheets. Then, percentage of toner transferred to paper was calculated.

A: transfer efficiency=80% or higher

B: transfer efficiency=70 to 80%

C: transfer efficiency=60 to 70%

D: transfer efficiency=50 to 60% c) Long-term stability: Image density (I.D.) and transfer efficiency were checked after printing 5,000 sheets.

A: I.D.=1.4 or higher; transfer efficiency=75% or higher

B: I.D.=1.3 or higher; transfer efficiency=70% or higher

C: I.D.=1.2 or lower; transfer efficiency=60% or higher

D: I.D.=1.0 or lower; transfer efficiency=40% or higher

TABLE 3

| Classification | Image Density | Transfer Efficiency | Long-term Stability |
|---|---|---|---|
| Example 1 | B | A | A |
| Example 2 | B | A | A |
| Example 3 | A | A | A |
| Example 4 | A | A | A |
| Example 5 | A | B | A |
| Example 6 | A | B | A |
| Example 7 | A | A | A |
| Example 8 | B | A | A |
| Example 9 | A | A | A |
| Example 10 | A | A | A |
| Example 11 | A | A | A |
| Example 12 | A | A | A |
| Example 13 | A | A | A |
| Example 14 | A | A | A |
| Example 15 | A | B | A |
| Example 16 | A | A | A |
| Example 17 | A | A | A |
| Example 18 | A | A | A |
| Example 19 | A | A | B |
| Example 20 | A | A | A |
| Example 21 | A | A | A |
| Example 22 | A | A | A |
| Example 23 | A | A | B |
| Example 24 | A | A | A |
| Example 25 | A | A | A |
| Example 26 | A | A | A |
| Example 27 | A | A | A |
| Example 28 | A | A | A |
| Example 29 | A | A | A |
| Example 30 | B | A | A |
| Example 31 | A | A | A |
| Example 32 | B | A | A |
| Example 33 | A | A | A |
| Example 34 | A | A | A |
| Example 35 | B | A | A |
| Example 36 | A | A | A |
| Example 37 | A | A | B |
| Example 38 | A | A | A |
| Example 39 | A | B | A |
| Comp. Example 1 | D | D | D |
| Comp. Example 2 | D | C | D |
| Comp. Example 3 | D | D | D |
| Comp. Example 4 | D | D | D |
| Comp. Example 5 | D | C | D |
| Comp. Example 6 | D | D | D |
| Comp. Example 7 | C | D | D |
| Comp. Example 8 | D | D | D |
| Comp. Example 9 | D | D | D |
| Comp. Example 10 | D | D | D |
| Comp. Example 11 | D | D | D |
| Comp. Example 12 | C | D | D |
| Comp. Example 13 | C | D | D |
| Comp. Example 14 | D | D | D |
| Comp. Example 15 | D | D | C |
| Comp. Example 16 | D | D | D |

TABLE 3-continued

| Classification | Image Density | Transfer Efficiency | Long-term Stability |
|---|---|---|---|
| Comp. Example 17 | C | D | D |
| Comp. Example 18 | D | D | D |
| Comp. Example 19 | D | D | D |
| Comp. Example 20 | D | D | D |
| Comp. Example 21 | D | D | D |
| Comp. Example 22 | D | D | D |
| Comp. Example 23 | D | D | D |
| Comp. Example 24 | D | D | D |
| Comp. Example 25 | D | C | D |
| Comp. Example 26 | D | D | D |
| Comp. Example 27 | D | D | D |
| Comp. Example 28 | D | D | D |
| Comp. Example 29 | D | D | D |
| Comp. Example 30 | D | D | D |
| Comp. Example 31 | D | D | D |
| Comp. Example 32 | D | D | D |
| Comp. Example 33 | C | D | D |
| Comp. Example 34 | D | D | C |
| Comp. Example 35 | D | D | D |
| Comp. Example 36 | C | C | D |
| Comp. Example 37 | D | D | D |
| Comp. Example 38 | D | D | D |
| Comp. Example 39 | D | D | D |
| Comp. Example 40 | D | D | D |
| Comp. Example 41 | D | D | D |
| Comp. Example 42 | D | D | D |
| Comp. Example 43 | D | D | D |

As seen in Table 3, color toners prepared by coating organic particles having an average particle size of 0.3 to 2.0 μm, organic particles having an average particle size of 0.05 to 0.25 μm, and silica on toner mother particles (Examples 1 to 39) were superior in image density, transfer efficiency, and long-term stability to those prepared in Comparative Examples 1 to 43. This is because the organic particles having different average particle sizes reduce cohesion of the toner particles.

As described above, a non-magnetic monocomponent color toner according to the present invention has a narrow charge distribution, good charging characteristics and environmental independence, superior image characteristics, high transfer efficiency, and long-term stability caused by significantly improved charge maintenance capability.

Examples 40 to 68

Using the following compositions, non-magnetic monocomponent color toners were prepared in the same manner as Example 1.

TABLE 4

| Classification | Organic Particles A (Average particle size = 1.0 μm) | Organic Particles B (Average particle size = 0.1 to 0.15 μm) | Silica |
|---|---|---|---|
| Example 40 | 0.1 weight parts of 1.0 μm PVDF | 0.1 weight parts of 0.1 μm PVDF | 2 weight parts of 12 nm silica |
| Example 41 | 0.1 weight parts of 1.0 μm PMMA | 0.1 weight parts of 0.1 μm PVDF | 2 weight parts of 12 nm silica |

TABLE 4-continued

| Classification | Organic Particles A (Average particle size = 1.0 μm) | Organic Particles B (Average particle size = 0.1 to 0.15 μm) | Silica |
|---|---|---|---|
| Example 42 | 0.1 weight parts of 1.0 μm PVDF | 1.5 weight parts of 0.1 μm PVDF | 2 weight parts of 12 nm silica |
| Example 43 | 0.1 weight parts of 1.0 μm PMMA | 1.5 weight parts of 0.1 μm PVDF | 2 weight parts of 12 nm silica |
| Example 44 | 1.5 weight parts of 1.0 μm PVDF | 0.1 weight parts of 0.1 μm PVDF | 2 weight parts of 12 nm silica |
| Example 45 | 1.5 weight parts of 1.0 μm PMMA | 0.1 weight parts of 0.1 μm PVDF | 2 weight parts of 12 nm silica |
| Example 46 | 1.5 weight parts of 1.0 μm PVDF | 1.5 weight parts of 0.1 μm PVDF | 2 weight parts of 12 nm silica |
| Example 47 | 1.5 weight parts of 1.0 μm PMMA | 1.5 weight parts of 0.1 μm PVDF | 2 weight parts of 12 nm silica |
| Example 48 | 0.5 weight parts of 1.0 μm PMMA | 0.5 weight parts of 0.1 μm PVDF | 2 weight parts of 12 nm silica |
| Example 49 | 0.1 weight parts of 1.0 μm PVDF | 0.1 weight parts of 0.15 μm PMMA | 2 weight parts of 12 nm silica |
| Example 50 | 0.1 weight parts of 1.0 μm PMMA | 0.1 weight parts of 0.15 μm PMMA | 2 weight parts of 12 nm silica |
| Example 51 | 1.5 weight parts of 1.0 μm PVDF | 1.5 weight parts of 0.15 μm PMMA | 2 weight parts of 12 nm silica |
| Example 52 | 1.5 weight parts of 1.0 μm PMMA | 1.5 weight parts of 0.15 μm PMMA | 2 weight parts of 12 nm silica |
| Example 53 | 0.1 weight parts of 1.0 μm PVDF | 1.5 weight parts of 0.15 μm PMMA | 2 weight parts of 12 nm silica |
| Example 54 | 0.1 weight parts of 1.0 μm PMMA | 1.5 weight parts of 0.15 μm PMMA | 2 weight parts of 12 nm silica |
| Example 55 | 1.5 weight parts of 1.0 μm PVDF | 0.1 weight parts of 0.15 μm PMMA | 2 weight parts of 12 nm silica |
| Example 56 | 1.5 weight parts of 1.0 μm PMMA | 0.1 weight parts of 0.15 μm PMMA | 2 weight parts of 12 nm silica |
| Example 57 | 0.5 weight parts of 1.0 μm PVDF | 0.5 weight parts of 0.15 μm PMMA | 2 weight parts of 12 nm silica |
| Example 58 | 0.5 weight parts of 1.0 μm PMMA | 0.5 weight parts of 0.15 μm PMMA | 2 weight parts of 12 nm silica |
| Example 59 | 0.1 weight parts of 1.0 μm PVDF | 0.1 weight parts of 0.15 μm PMMA | 2 weight parts of 12 nm silica |

TABLE 5

| Classification | Organic Particles A (Average particle size = 1.2 μm) | Organic Particles B (Average particle size = 0.1 to 0.15 μm) | Silica |
|---|---|---|---|
| Example 60 | 0.1 weight parts of 1.2 μm PMMA | 0.1 weight parts of 0.1 μm PMMA | 2 weight parts of 12 nm silica |
| Example 61 | 1.5 weight parts of 1.2 μm PVDF | 1.5 weight parts of 0.15 μm PMMA | 2 weight parts of 12 nm silica |
| Example 62 | 1.5 weight parts of 1.2 μm PMMA | 1.5 weight parts of 0.15 μm PMMA | 2 weight parts of 12 nm silica |
| Example 63 | 0.1 weight parts of 1.2 μm PVDF | 1.5 weight parts of 0.15 μm PMMA | 2 weight parts of 12 nm silica |
| Example 64 | 0.1 weight parts of 1.2 μm PMMA | 1.5 weight parts of 0.15 μm PMMA | 2 weight parts of 12 nm silica |
| Example 65 | 1.5 weight parts of 1.2 μm PVDF | 0.1 weight parts of 0.1 μm PMMA | 2 weight parts of 12 nm silica |
| Example 66 | 1.5 weight parts of 1.2 μm PMMA | 0.1 weight parts of 0.15 μm PMMA | 2 weight parts of 12 nm silica |
| Example 67 | 0.5 weight parts of 1.2 μm PVDF | 0.5 weight parts of 0.15 μm PMMA | 2 weight parts of 12 nm silica |
| Example 68 | 0.5 weight parts of 1.2 μm PMMA | 0.5 weight parts of 0.1 μm PMMA | 2 weight parts of 12 nm silica |

The prepared non-magnetic monocomponent color toners were used to print 5000 sheets of paper with a non-magnetic monocomponent development printer (HP4500; Hewlett-Packard Company) under the condition of normal temperature and humidity (20° C., 55% RH). Image density, transfer efficiency, and long-term stability were determined as per the manner disclosed above.

(1) The image density (I.D) is graded A, B, C, and D by determining density of solid area image using a Macbeth densitiometer RD918

(2) The transfer efficiency is graded A, B, C, and D by calculating the percentage of toner transferred to paper using 5000 sheets of paper.

(3) Long-term stability is grades A, B, C, and D by determination the relationships between image density and transfer efficiency. The results are shown in the following Table.

TABLE 6

| Classification | Image Density | Transfer Efficiency | Long-term Stability |
|---|---|---|---|
| Example 40 | A | A | A |
| Example 41 | A | A | A |
| Example 42 | A | A | A |
| Example 43 | A | A | A |
| Example 44 | A | A | A |
| Example 45 | A | A | A |
| Example 46 | A | A | A |
| Example 47 | A | A | A |
| Example 48 | A | B | A |
| Example 49 | A | A | A |
| Example 50 | B | A | A |
| Example 51 | A | A | A |
| Example 52 | A | A | A |
| Example 53 | A | A | A |
| Example 54 | B | A | A |
| Example 55 | A | A | A |
| Example 56 | A | A | A |
| Example 57 | A | A | B |
| Example 58 | A | A | A |
| Example 59 | A | A | A |
| Example 60 | A | A | A |
| Example 61 | A | A | A |
| Example 62 | A | A | A |
| Example 63 | A | A | A |
| Example 64 | A | A | A |
| Example 65 | A | A | A |
| Example 66 | A | A | A |
| Example 67 | A | A | A |
| Example 68 | A | A | A |

As seen in Table 6, color toners prepared by using large organic particles having an average particle size of 1.0 to 1.2 μm provide excellent image density, transfer efficiency, and long-term stability. This is because the organic particles having different average particle sizes reduce cohesion of the toner particles. Specifically, the large organic particles act on preventing excessive charging, in part by reducing friction heat generated in the charging blade and sleeve in the charging process, and thus lead to improved uniform charge distribution and long-term stability.

While the present invention has been described in detail with reference to the preferred embodiments, those skilled in the art will appreciate that various modifications and substitutions can be made thereto without departing from the spirit and scope of the present invention as set forth in the appended claims.

What is claimed is:

1. A non-magnetic monocomponent color toner composition comprising:

100 weight parts of toner mother particles;

0.1 to 1.5 weight parts of organic particles having an average particle size of 1.0 to 2.0 μm, which are coated on the toner mother particles;

0.1 to 1.5 weight parts of organic particles having an average particle size of 0.05 to 0.25 μm, which are coated on the toner mother particles; and 1.0 to 3.0 weight parts of silica, which is coated on the toner mother particles.

2. The non-magnetic monocomponent toner composition according to claim 1, wherein the organic particles having an average particle size of 1.0 to 2.0 μm and the organic particles having an average particle size of 0.05 to 0.25 μm are polymers prepared from one or more monomers selected from a group consisting of styrene, methylstyrene, dimethylstyrene, ethylstyrene, phenylstyrene, chlorostyrene, hexylstyrene, octylstyrene, nonylstyrene, vinyl chloride, vinyl fluoride, vinyl acetate, vinyl benzoate, methylmethacrylate, ethylmethacrylate, propylmethacrylate, n-butylmethacrylate, isobutylmethacrylate, 2-ethylhexylmethacrylate, phenyl acrylate, acrylonitrile, methacrylonitrile, methyl acrylate, ethyl acrylate, butyl acrylate, phenyl acrylate, tetrafluoroethylene, and 1,1-difluoroethylene.

3. The non-magnetic monocomponent toner composition according to claim 1, wherein the average particle size of the silica is 7 to 40 nm.

4. The non-magnetic monocomponent toner composition according to claim 1, wherein the toner mother particles comprise a binder resin and a coloring agent.

5. The non-magnetic monocomponent toner composition according to claim 4, wherein the binder resin is a polymer prepared from one or more compounds selected from a group consisting of styrene, chlorostyrene, vinylstyrene, ethylene, propylene, butylene, isoprene, vinyl acetate, vinyl propionate, vinyl benzoate, vinyl lactate, methyl acrylate, ethyl acrylate, butyl acrylate, dodecyl acrylate, octyl acrylate, phenyl acrvlate, methyl methacrylate, ethyl methacrylate, butyl methacrylate, dodecyl methacrylate, vinyl methyl ether, vinyl ethyl ether, vinyl butyl ether, vinyl methyl ketone, vinyl hexyl ketone, and vinyl isopropenyl ketone.

6. The non-magnetic monocomponent toner composition according to claim 4, wherein the coloring agent is one or more compounds selected from a group consisting of nigrosine dye, aniline blue, charcoal blue, chromium yellow, navy blue, methylene blue chloride, phthalocyanine blue, lamp black, rose bengal, C.I. Pigment Red 48:1, C.I. Pigment Red 48:4, C.I. Pigment Red 122, C.J. Pigment Red 57:1, C.I. Pigment Red 257, C.L Pigment Yellow 97, C.I. Pigment Yellow 12, C.L Pigment Yellow 17, Ci. Pigment Yellow 14, C.I. Pigment Yellow 13, C.I. Pigment Yellow 16, C.I. Pigment Yellow 81, C.I. Pigment Yellow 126, C.I. Pigment Yellow 127, C.I. Pigment Blue 9, C.I. Pigment Blue 15, C.I. Pigment Blue 15:1, and C.I. Pigment Blue 15:3.

7. The non-magnetic monocomponent toner composition according to claim 4, wherein the toner mother particles further comprise one or more additives selected from a group consisting of inorganic oxide particles, a release agent, and a charge-controlling agent.

8. The non-magnetic monocomponent toner composition according to claim 1, wherein the maximum average particle size of the color toner is 20 μm.

9. A method for preparing a non-magnetic monocomponent color toner, which comprises a step of coating 0.1 to 1.5 weight parts of organic particles having an average particle size of 1.0 to 2.0 μm, 0.1 to 1.5 weight parts of organic particles having an average particle size of 0.05 to 0.25 μm, and 1.0 to 3.0 weight parts of silica on 100 weight parts of toner mother particles.

10. The method for preparing a non-magnetic monocomponent color toner according to claim 9, wherein the organic particles having an average particle size of 1.0 to 2.0 μm and the organic particles having an average particle size of 0.05 to 0.25 μm are polymers prepared from one or more monomers selected from a group consisting of styrene, methylstyrene, dimethylstyrene, ethylstyrene, phenylstyrene, chlorostyrene, hexylstyrene, octylstyrene, nonylstyrene, vinyl chloride, vinyl fluoride, vinyl acetate, vinyl benzoate, methylmethacrylate, ethylmethacrylate, propylmethacrylate, n-butylmethacrylate, isobutylmethacrylate, 2-ethylhexylmethacrylate, phenyl acrylate, acrylonitrile, methacrylonitrile, methyl acrylate, ethyl acrylate, butyl acrylate, phenyl acrylate, tetrafluoro ethylene, and 1,1-difluoroethylene.

11. The method for preparing a non-magnetic monocomponent color toner according to claim 9, wherein the average particle size of the silica is 7 to 40 nm.

* * * * *